US005533593A

United States Patent [19]

Huang

[11] Patent Number: 5,533,593

[45] Date of Patent: Jul. 9, 1996

[54] MOBILE LIFTER

[76] Inventor: Andy C.-P. Huang, No. 2-2, Alley 1, Fu Hsing Sub-ward, Tung Hsiao Chen, Miao Li Hsien, Taiwan

[21] Appl. No.: 321,528

[22] Filed: Oct. 12, 1994

[51] Int. Cl.[6] ..... E04G 1/22

[52] U.S. Cl. ..... 182/141; 182/63

[58] Field of Search ..... 182/63, 141

[56] References Cited

U.S. PATENT DOCUMENTS

| | | | |
|---|---|---|---|
| 1,319,943 | 10/1919 | Bessolo | 182/141 X |
| 1,592,770 | 7/1926 | Liberman | 182/141 |
| 3,017,968 | 1/1962 | McMahon | 182/141 |

FOREIGN PATENT DOCUMENTS

| | | | |
|---|---|---|---|
| 8202570 | 8/1982 | WIPO | 182/141 |

*Primary Examiner*—Alvin C. Chin-Shue

*Attorney, Agent, or Firm*—Peterson, Wicks, Nemer & Kamrath

[57] ABSTRACT

A mobile lifter including a cylindrical casing supported on a stand, a plurality of inner tubes that slide one inside another and received in the cylindrical casing, a set of pulleys respectively mounted on the inner tubes at different elevations, a winch wound round with a cable, the cable having one end fixed to and wound round the winch and an opposite end inserted in pulleys and then fixed to the bottom end of said fourth inner tube, and a driving mechanism mounted on the cylindrical casing on the outside and controlled to turn the winch, causing it to take up or let off the cable so as to lift or lower the mobile lifter.

3 Claims, 7 Drawing Sheets

MOBILE LIFTER

BACKGROUND OF THE INVENTION

The present invention relates to a mobile lifter which comprises a plurality of inner tubes received in a cylindrical casing and sliding one inside another, a driving mechanism, and a winch controlled by the driving mechanism to take up or let off a cable so as to lift or lower the mobile lifter.

During the maintenance work of the outside wall of a building, a scaffold may be set up outside the wall or a suspension gear may be installed in the roof of the building or an aerial ladder may be used to carry the workmen to the desired elevation. These equipment are difficult to set up or expensive to install. There is also known a mobile lifter designed for carrying a workman for an overhead work. This structure of mobile lifter, as shown in FIG. 1, comprises a stand, a work table supported on the stand by a telescopic support, and a hydraulic cylinder mounted on the stand. When in use, the hydraulic cylinder is operated to pump a hydraulic oil into the telescopic support, causing the tube sections of the telescopic support to extend out of one another, and therefore the work table is lifted. This structure of mobile lifter is heavy and needs much working space. There is also known a similar mobile lifter which uses a pneumatic system controlled to lift or lower the tube sections of the telescopic support. However, this pneumatic system is dangerous in operation because an air leakage tends to happen during its operation.

SUMMARY OF THE INVENTION

It is one object of the present invention to provide a mobile lifter which is lightweight and can be conveniently moved from place to place. It is another object of the present invention to provide a mobile lifter which needs less working space. According to one aspect of the present invention, the mobile lifter comprises a cylindrical casing supported on a stand, a plurality of inner tubes that slide one inside another and received in the cylindrical casing, a set of pulleys respectively mounted on the inner tubes at different elevations, a winch wound round with a cable, the cable having one end fixed to and wound round the winch and an opposite end inserted in pulleys and then fixed to the bottom end of said fourth inner tube, and a driving mechanism mounted on the cylindrical casing on the outside and controlled to turn the winch, causing it to take up or let off the cable so as to lift or lower the mobile lifter. According to another aspect of the present invention, the driving mechanism comprises a reversible motor controlled to turn the winch in either direction to take up or let off the cable through a gear transmission mechanism.

DETAILED DESCRIPTION OF THE PREFERRED EMBODIMENT

Figure 1:
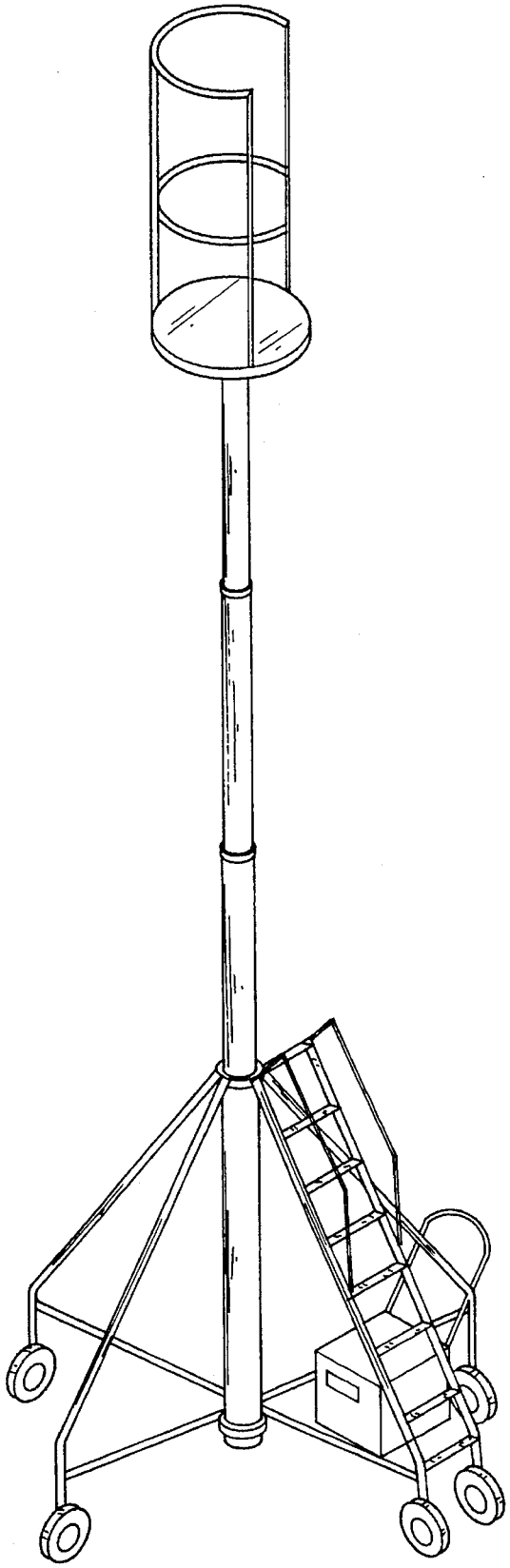
Fig.1 PRIOR ART
FIG. 1 is an elevational view of a mobile lifter according to the present invention.
Figure 2:
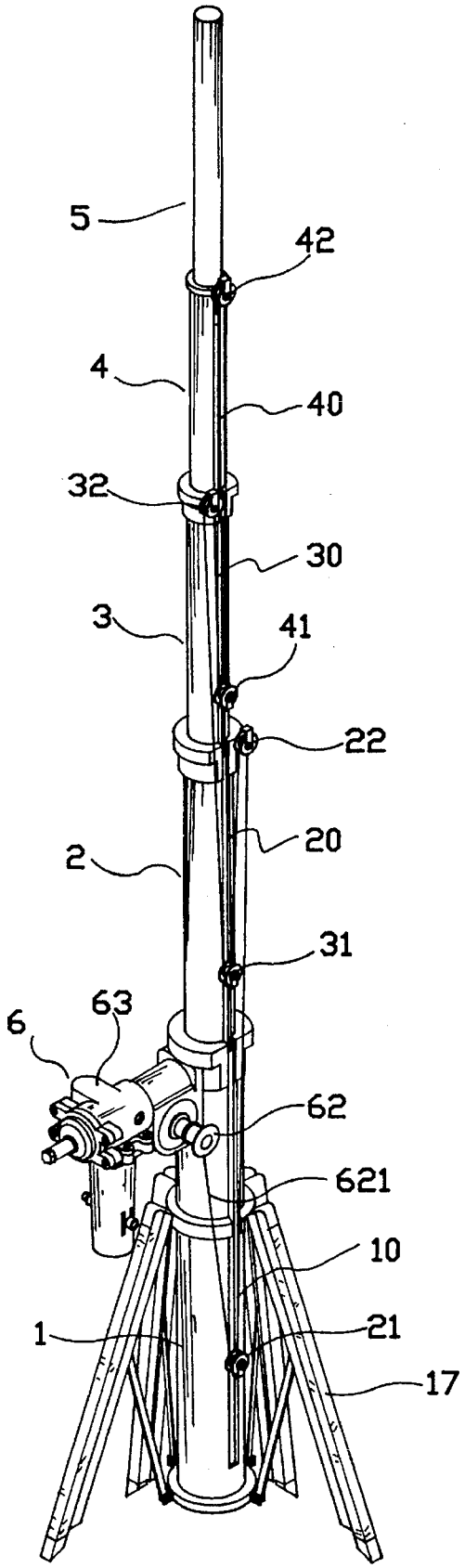
FIG. 2 is an elevational view of a mobile lifter according to the present invention.
Figure 5B:
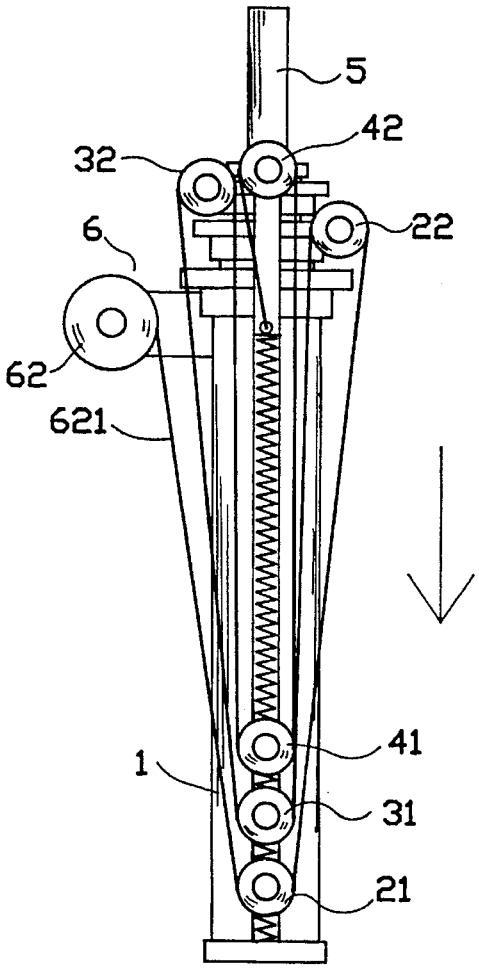
FIG. 5B is a schematic drawing showing the mobile lifter of FIG. 2 received.
Figure 5A:
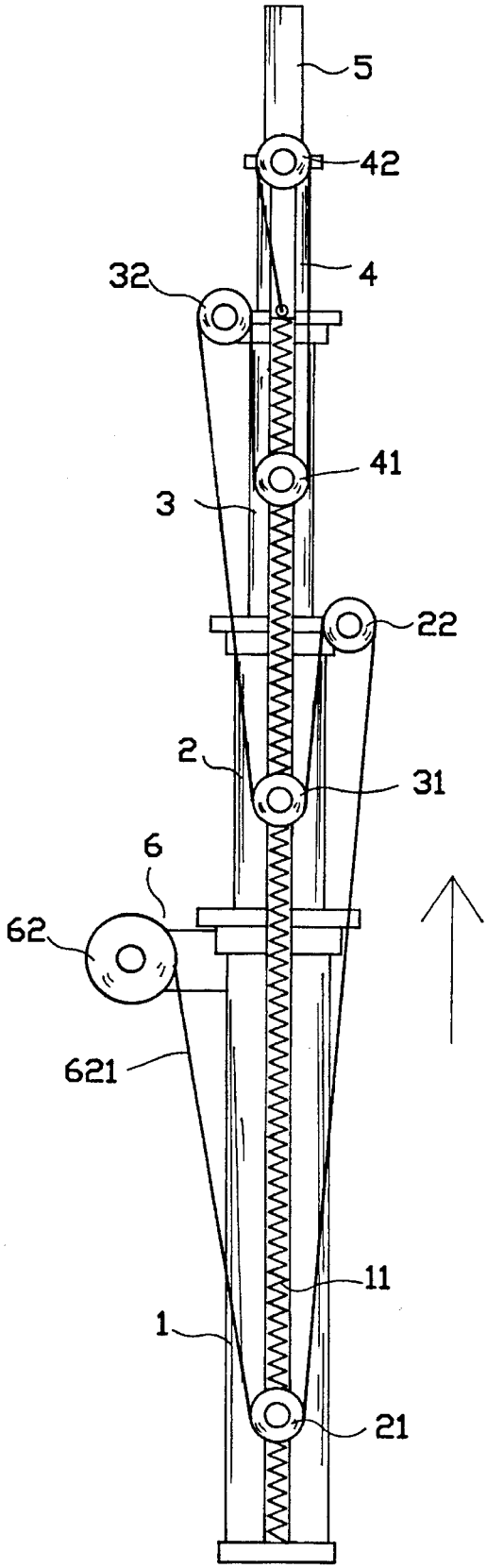
FIG. 5A is a schematic drawing showing the mobile lifter of FIG. 2 extended out.

Referring to FIG. 2, a mobile lifter in accordance with the present invention is generally comprised of a cylindrical casing 1, a plurality of inner tubes, namely, the first inner tube 2, the second inner tube 3, the third inner tube 4, and the fourth inner tube 5 respectively received one inside another within the cylindrical casing 1. The cylindrical casing 1 and the first, second and third inner tubes 2, 3, and 4 have a respective longitudinal slot 10, 20, 30, or 40. A spring 11 is provided, see FIG. 5A, having one end fixed to the bottom of the inside of the cylindrical casing 1 and an opposite end fixed to the fourth inner tube 5. The cylindrical casing 1 is supported on a stand 17. By means of the stand 17, the cylindrical casing 1 can be placed on ground in vertical. The first, second and third inner tubes 2, 3, and 4 have a respective bottom pulley 21, 31, or 41 and a respective top pulley 22, 32, or 42 respectively disposed near two opposite ends of the respective longitudinal slot 20, 30, or 40 on the outside. A driving mechanism 6 is mounted on the cylindrical casing 1 near the top. A winch 62 is coupled to the driving mechanism 6 to take up a cable 621. The cable 621 has one end fixed to and wound round the winch 62 and an opposite end inserted through the bottom and top pulleys 21, 22, 31, 32, 41, and 42 of the first, second and third inner tubes 2, 3, and 4 in proper order and then fixed to the bottom of the fourth inner tube 5 (see also FIGS. 5A and 5B).

Figure 3:
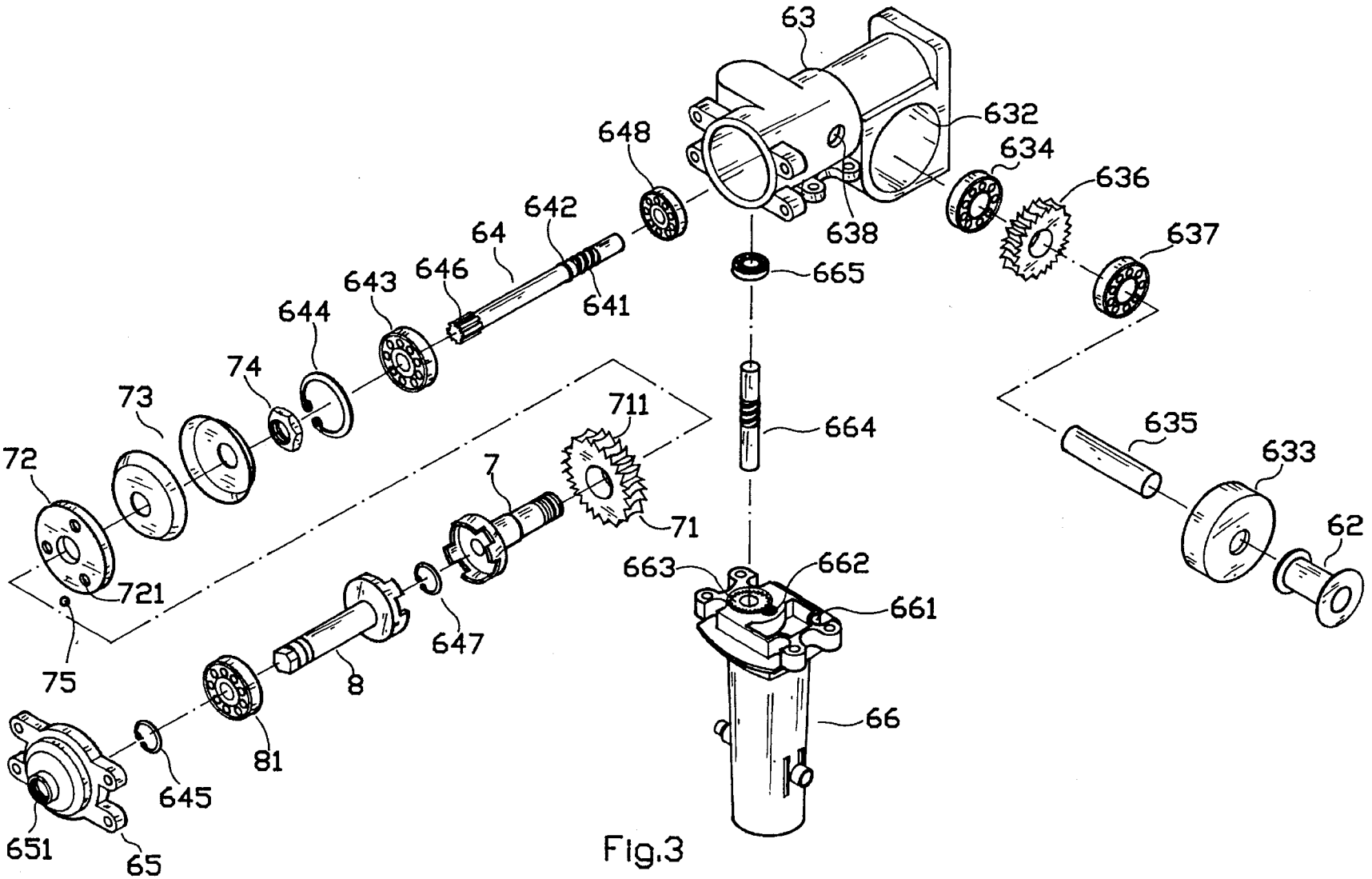
FIG. 3 is an exploded view of the driving mechanism of the mobile lifter shown in FIG. 2.
Figure 4:
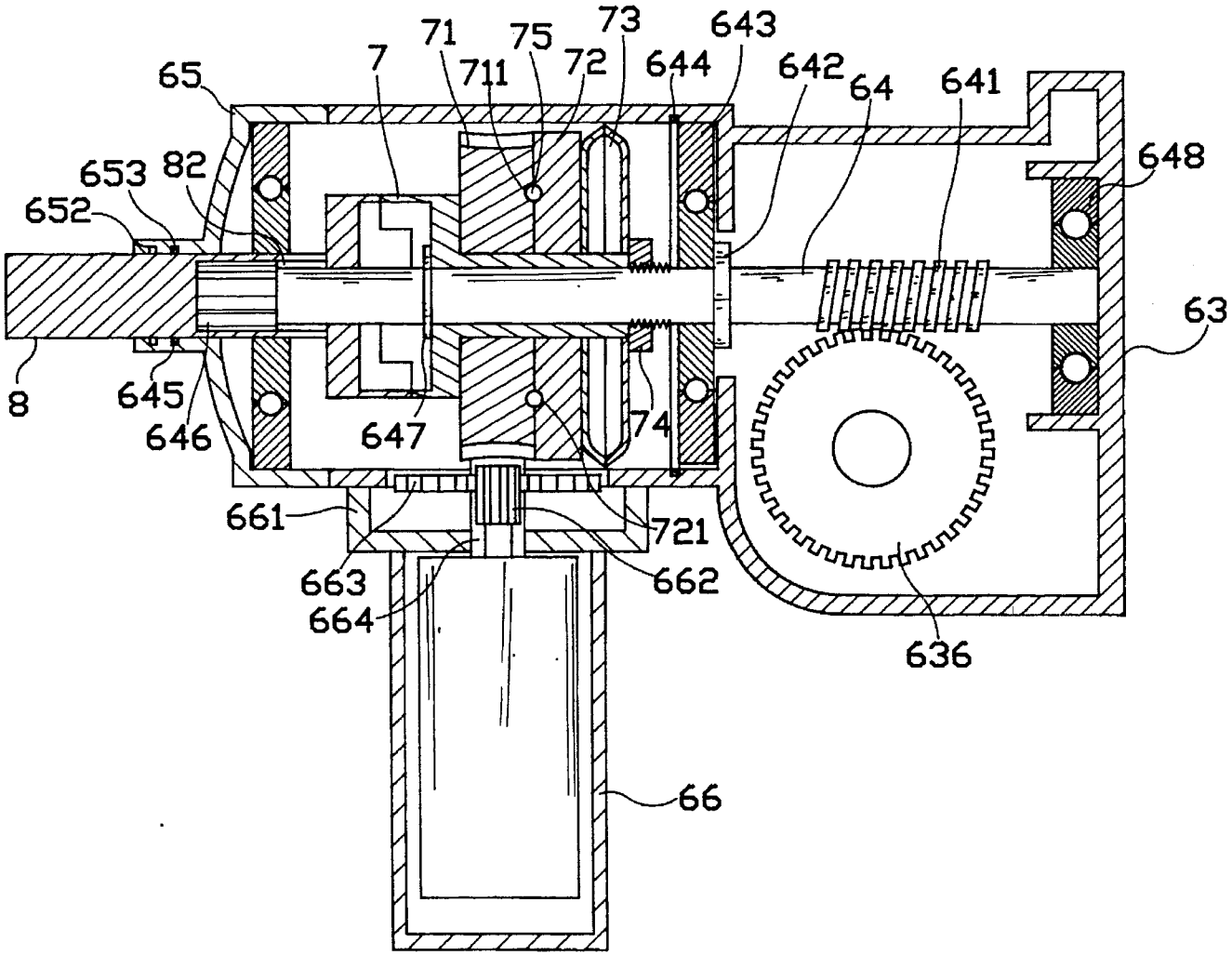
FIG. 4 is a plain view showing the driving mechanism of FIG. 3 assembled.

Referring to FIGS. 3 and 4, the driving mechanism 6 comprises a cylindrical housing 63 covered with a cover 65 and having a side hole 632, a ring cap 633 mounted within the side hole 632, an axle 635 disposed in the side hole 632 and supported on two bearings 634 and 637 and having one end extended out of the ring cap 633 and coupled to the winch 62, a driving gear 636 fixedly mounted around the axle 635, a transmission shaft 64 disposed in the cylindrical housing 63 and having an outer thread 641 near one one end thereof meshed with the driving gear 636 and supported on a bearing 648 inside the housing 63 and a toothed block 646 disposed at an opposite end thereof and a collar 642 spaced between the outer thread 641 and the toothed block 646, a bearing 643 mounted around the transmission shaft 64 and stopped at the collar 642 and retained in place by a clamp 644, a first T-shaped clutch member 7 mounted around the transmission shaft 64 and retained in place by a clamp 647, a gear wheel 71 and a ring-shaped pressure plate 72 and a pair of spring discs 73 respectively mounted around the first T-shaped clutch member 7 and retained in place by a nut 74, which gear wheel 71 and ring-shaped pressure plate 72 having ball holes 711 and 721 respectively aligned to hold steel balls 75, a second T-shaped clutch member 8 mounted around the transmission shaft 64 and partially extended out of a through hole 651 in the center of the cover 65 and having a recessed coupling portion 82 on the inside engaged with the toothed block 646 of the transmission shaft 64, a bearing 81 mounted around the second T-shaped clutch member 8, a clamp 645 mounted around the second T-shaped clutch member 8 and alternatively retained in either of two inside annular grooves 652, and 653 inside the center through hole 651 of the cover 65, and retained in place by a clamp 645, a reversible motor 66 having a mounting frame 661 fastened to the housing 63 at the bottom and having an output shaft 662 mounted with a driven gear 663, and a driven screw rod 664 meshed with the gear wheel 71 and having one end connected to the driven gear 663 and an opposite end mounted on a bearing 665 disposed inside the housing 63.

When the reversible motor 66 is started, power is transmitted through the driven gear 663, the driven screw rod 664, the gear wheel 71, the first T-shaped clutch member 7, the second T-shaped clutch member 8, the transmission shaft 64, and the driving gear 636 to turn the winch 62 through the axle 635, causing the winch 62 to turn the cable 621 forwards or backwards, and therefore the mobile lifter is lifted or lowered. When the reversible motor 66 is started to take up the cable 621, the fourth inner tube 5 is first pulled out of the third inner tube 4, then the third, second and first inner tubes 4, 3, and 2 are pulled out one after another, and therefore the mobile lifter is lifted (see FIG. 5A). When the reversible motor 66 is turned in the reversed direction to let off the cable 621, the spring 11 is released to pull back the inner tubes 5, 4, 3, and 2 one after another, and therefore the mobile lifter is lowered (see FIG. 5B).

The aforesaid gear wheel 71 is not fixedly fastened to the first T-shaped clutch member 7 but retained to the first T-shaped clutch member 7 by the pressure plate 72 and the spring discs 73. When an excessive pressure is employed to the gear wheel 71, the pressure plate 72 and the spring discs 73 will be forced away, causing the gear wheel 71 to run in idle, therefore the reversible motor 66 is protected against an overload. Furthermore, the mobile lifter can also be operated manually. When the second T-shaped clutch member 8 is pulled outwards and disengaged from the first T-shaped clutch member 7 the recessed coupling portion 82 is moved relative to the toothed block 646 and still maintained engaged with it, the transmission shaft 64 can then be turned by the second T-shaped clutch member 8 to turn the cable 621 in either direction so as to lift or lower the mobile lifter.

Referring to FIG. 3 again, the housing 63 further comprises a tool hole 638 through when a tool can be inserted into the housing 63 to turn the nut 74 so as to adjust the pressure given by the pressure plate 72 and the spring discs 73 to the gear wheel 71.

Figure 6:
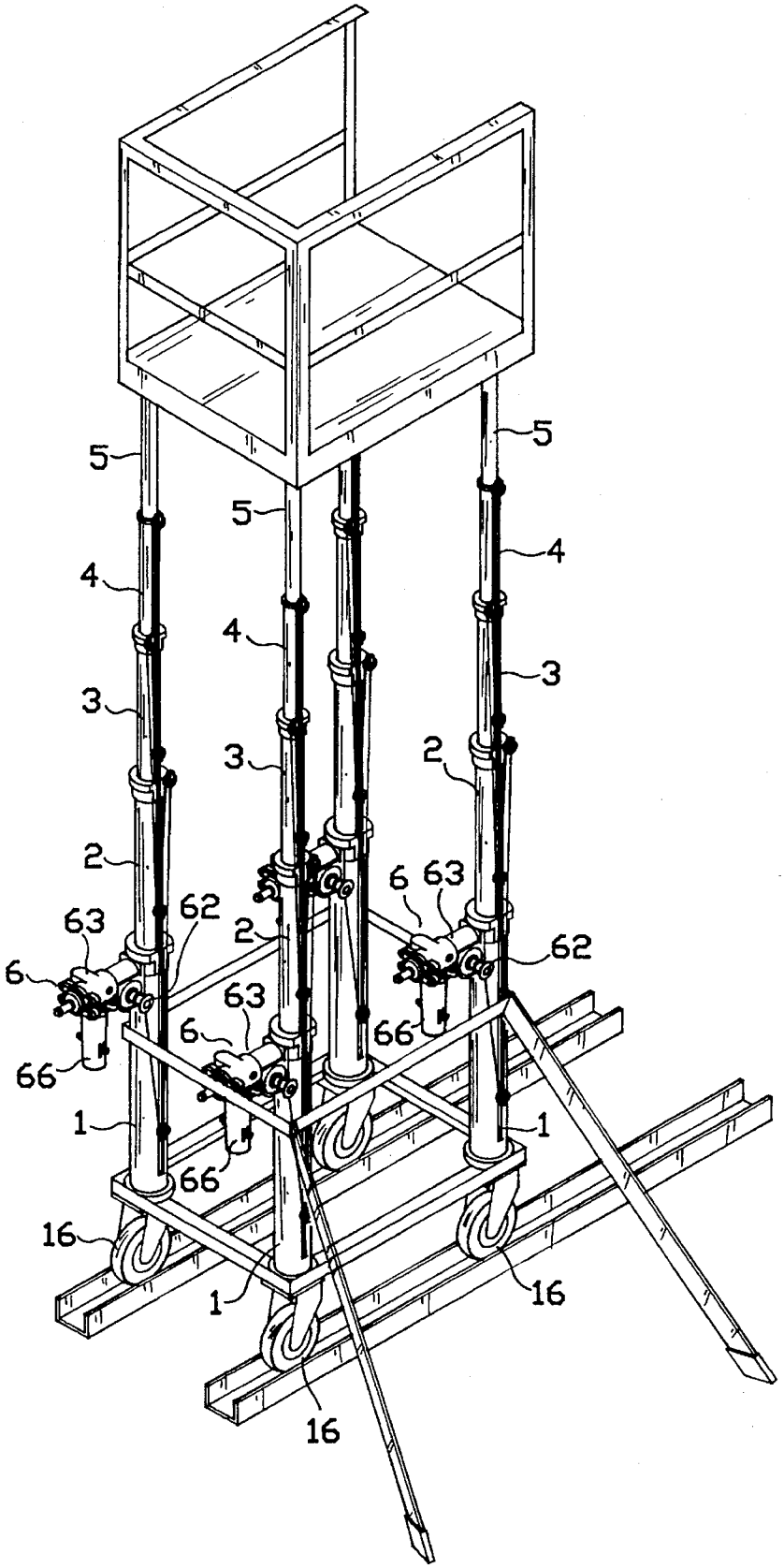
FIG. 6 is an elevational view of a mobile elevator according to the present invention.

FIG. 6 shows a mobile elevator made according to the present invention and moved on rails, in which four lifters are connected in parallel and supported on a respective wheel 16 to carry a cage or the like.

Figure 7:
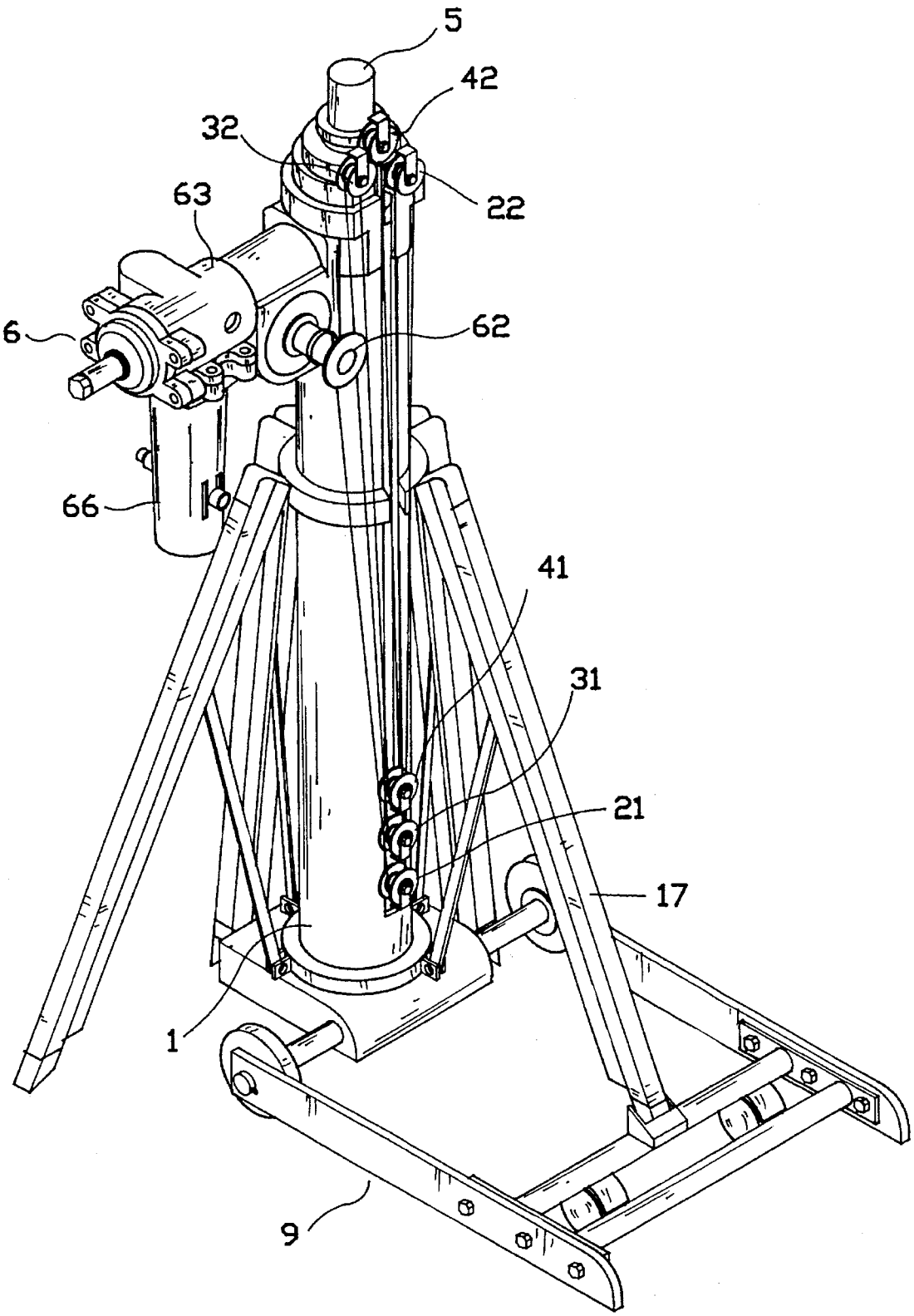
FIG. 7 shows an alternate form of the mobile lifter of the present invention.

FIG. 7 shows the mobile lifter of the present invention mounted on a truck 9. Therefore, the mobile lifter can be conveniently carried to the work place.

I claim:

1. A mobile lifter comprising:

a cylindrical casing supported on a stand, having a longitudinal slot;

a first inner tube moved in and out of said cylindrical casing, having a longitudinal slot corresponding to the longitudinal slot on said cylindrical casing and a bottom pulley and a top pulley disposed near two opposite ends thereof;

a second inner tube moved in and out of said first inner tube, having a longitudinal slot corresponding to the longitudinal slot on said first inner tube and a bottom pulley and a top pulley disposed near two opposite ends thereof;

a third inner tube moved in and out of said second inner tube, having a longitudinal slot corresponding to the longitudinal slot on said second inner tube and a bottom pulley and a top pulley disposed near two opposite ends thereof;

a fourth inner tube moved in and out of said third inner tube, having a bottom end disposed inside said third inner tube;

a winch wound round with a cable, said cable having one end fixed to and wound round said winch and an opposite end inserted in proper order through the bottom pulley and top pulley of said first inner tube, the bottom pulley and top pulley of said second inner tube, the bottom pulley and top pulley of said third inner tube and then fixed to the bottom end of said fourth inner tube; and a driving mechanism mounted on said cylindrical casing on the outside and controlled to turn said winch, said driving mechanism comprising a cylindrical housing covered with a cover and having a side hole, a ring cap mounted within said side hole, and axle disposed in said side hole and having one end extended out of said ring cap and coupled to said winch, a driving gear fixedly mounted around said axle, a transmission shaft disposed in said cylindrical housing and having an outer thread at one end meshed with said driving gear and a toothed block at an opposite end, a first T-shaped clutch member mounted around said transmission shaft and retained in place by a clamp, a gear wheel mounted around said first T-shaped clutch member, a ring-shaped pressure plate and a pair of spring discs mounted around said first T-shaped clutch member and retained in place by a nut to hold down said gear wheel, said gear wheel and said ring-shaped pressure plate having ball holes respectively aligned to hold steel balls, a second T-shaped clutch member mounted around said transmission shaft and partially extended out of a through hole in the center of said cover and having a recessed coupling portion on the inside enraged with said toothed block of said transmission shaft, a reversible motor having a mounting frame fastened to said housing and an output shaft mounted with a driven gear, and a driven screw rod turned by said driven gear to rotate said gear wheel;

wherein when said winch is turned by said driving mechanism in one direction to take up said cable, said inner tubes are pulled out of one another out of said cylindrical casing; when said winch is turned by said driving mechanism in the reversed direction to let off said cable, said inner tubes are moved one inside another inside said cylindrical casing.

2. The mobile lifter of claim 1 further comprising a spring disposed inside said cylindrical casing, said spring having one end fixed to an inside bottom wall of said cylindrical casing and an opposite end fixed to said fourth inner tube.

3. The mobile lifter of claim 1 wherein said cover has two inside annular grooves for holding a clamp, which is mounted around said second T-shaped clutch member and retained to one inside annular groove to hold down said second T-shaped clutch member.

* * * * *